US009074312B2

(12) United States Patent
D'Andrea et al.

(10) Patent No.: US 9,074,312 B2
(45) Date of Patent: Jul. 7, 2015

(54) WASHING MACHINE COMPRISING A DRAWER FOR LOADING WASHING AGENT

(75) Inventors: Luca D'Andrea, Naples (IT); Giovanni Bombardieri, Albino (IT); Gianluca Pierucci, Moie (IT); Maurizio Baldini, Fabriano (IT); Constantino Mariotti, Sigillo (IT); Fernanda Gaggioli, legal representative, Sigillo (IT); Maria Angela Mariotti, legal representative, Sigillo (IT); Elisa Mariotti, legal representative, Sigillo (IT)

(73) Assignee: Indesit Company S.P.A., Fabriano (IT)

( * ) Notice: Subject to any disclaimer, the term of this patent is extended or adjusted under 35 U.S.C. 154(b) by 1192 days.

(21) Appl. No.: 13/054,989

(22) PCT Filed: Jun. 9, 2009

(86) PCT No.: PCT/IB2009/005888

§ 371 (c)(1),
(2), (4) Date: May 20, 2013

(87) PCT Pub. No.: WO2010/010433

PCT Pub. Date: Jan. 28, 2010

(65) Prior Publication Data

US 2013/0263631 A1 Oct. 10, 2013

(30) Foreign Application Priority Data

Jul. 24, 2008 (IT) ..... TO2008A0571

(51) Int. Cl.
*D06F 39/02* (2006.01)

(52) U.S. Cl.
CPC ..... *D06F 39/02* (2013.01)

(58) Field of Classification Search
CPC ..... D06F 39/028; D06F 39/02; D06F 39/004; D06F 39/022; D06F 39/00
See application file for complete search history.

(56) References Cited

U.S. PATENT DOCUMENTS

| | | | | |
|---|---|---|---|---|
| 4,009,598 | A * | 3/1977 | Bernard et al. | 68/12.18 |
| 4,103,520 | A * | 8/1978 | Jarvis et al. | 68/12.18 |
| 5,782,109 | A * | 7/1998 | Spriggs et al. | 68/17 R |
| 6,401,499 | B1 * | 6/2002 | Clark et al. | 68/17 R |
| 8,122,743 | B2 * | 2/2012 | Schulze | 68/17 R |
| 8,166,781 | B2 * | 5/2012 | Lee et al. | 68/17 R |
| 8,286,288 | B2 * | 10/2012 | McAllister et al. | 8/158 |
| 8,397,544 | B2 * | 3/2013 | Hendrickson | 68/17 R |
| 8,657,964 | B2 * | 2/2014 | Druecker et al. | 134/18 |
| 8,863,340 | B2 * | 10/2014 | Schulze | 8/158 |
| 2007/0261177 | A1 * | 11/2007 | Risen et al. | 8/158 |

FOREIGN PATENT DOCUMENTS

| | | |
|---|---|---|
| EP | 0379950 | 1/1990 |
| GB | 2214524 | 11/1991 |
| WO | WO03/027377 | 4/2003 |
| WO | WO 2008138762 A1 * | 11/2008 |
| WO | WO 2009010402 A1 * | 1/2009 |

* cited by examiner

*Primary Examiner* — Michael Barr
*Assistant Examiner* — Rita Adhlakha
(74) *Attorney, Agent, or Firm* — Cesari and McKenna, LLP

(57) ABSTRACT

A washing machine, in particular a laundry washing or washing/drying machine, has at least one wash tub, one tank for a washing agent, and one drawer for loading washing agents, in which machine the drawer can be moved to at least a first position, wherein at least a portion of the drawer is in fluid communication with the tub, and a second position, wherein at least a portion of the drawer is in fluid communication with the tank.

20 Claims, 8 Drawing Sheets

WASHING MACHINE COMPRISING A DRAWER FOR LOADING WASHING AGENT

RELATED APPLICATIONS

The present application is a 371 of International Application No. PCT/IB2009/005888 filed Jun. 9, 2009 by Indesit Company S.P.A. for a WASHING MACHINE COMPRISING A DRAWER FOR LOADING A WASHING AGENT, which claims priorirty to Italian Application No. TO2008A000571 filed Jul. 24, 2008, both of which are hereby incorporated by reference in their entierty.

BACKGROUND OF THE INVENTION

1. Field of the Invention

The present invention relates to a washing machine, such as a laundry washing or washing/drying machine, equipped with a drawer for loading washing agents, in accordance with the first claim.

2. The Prior Art

As known, in washing machines, and more specifically in laundry washing and washing/drying machines, before each operating cycle the user has to pour a dose of a washing agent (e.g. detergent or softener) into a single-dose drawer which is in fluid communication with the wash tub. When the machine is in operation, a water duct afferent to the drawer will flood the latter in order to supply the washing agent into the tub.

The term "single-dose drawer" refers herein to a drawer which can only contain a quantity of washing agent which is sufficient for one operating cycle of the machine, corresponding to treating one load of laundry (normally 3 to 7 Kg).

The capacity of the drawer is limited to one wash cycle in order to prevent any washing agent deposits in the drawer; in fact, the drawer is completely emptied and must then be refilled by the user before washing the next laundry load.

As an alternative to this system, which is per se functional but requires the user to refill the drawer after every wash, washing machines have been developed which are equipped with a bulk tank for washing agents: thanks to the multiple-dose capacity of their tanks, such machines can perform a certain number of wash cycles without the user having to refill the machine with a new dose of washing agent.

Machines of the above-mentioned type are described, for example, in British patent GB 2 214 524 in the name of INDUSTRIE ZANUSSI S.p.A. In this case, the machine base includes a certain number of washing agent bags which are installed in the machine after having been filled with respective washing agents and are then gradually emptied during the operating cycles of the machine; for this purpose, the bags are made of a deformable plastic material (so that no air can enter because the bags can adapt themselves to their decreasing contents), and are in fluid communication with a duct through which (by means of a pump) the washing agent is delivered to the tub.

Although the washing agent must no longer be poured in after every operating cycle of the machine, this solution still suffers from the drawback all entire washing agent bags must be replaced when they become empty, while the user is forced to carry out such task in non-optimal conditions, since the bags are located at the machine base in a position which is not easily accessible.

Moreover, the bags are made of flexible plastic, and presumably imply a certain purchase cost in addition to that of the washing agent; it follows that their complete replacement is not advantageous from an economical viewpoint.

Another system, disclosed by European patent EP 0 379 950 in the name of MIELE & CIE GmbH & CO., uses a rigid bulk tank for washing agents which are delivered to the tub through a suitable duct. The tank contains a washing agent volume corresponding to several working cycles of the machine, and the user fills the bulk tank by means of a tube having a funnel-shaped inlet mouth, which tube is connected to the tank in the lower front portion of the washing machine.

Although it overcomes some drawbacks of the previously described system (such as, for example, having to replace the entire bag), this solution still suffers from the drawback that the refilling operation is not ergonomical at all. In fact, the refilling tube has a limited length (for not taking up too much space when not in use), and the user must in any case bend to the machine base in order to pour the washing agent into the funnel-shaped mouth.

Another drawback which is common to the aforementioned solutions is that in both cases dedicated means are to be arranged on the front side of the washing machine exclusively for filling the bulk tanks. In fact, in the former case there are front doors through which the bags are removed and inserted, while in the latter case there is at least one access opening, which can be closed by means of a door or the like, through which the tank filling tube must be passed.

Some of these problems have been solved by the solution disclosed in the international application published under number WO03/027377 in the name of CADING KONSTRUKTIONS GmbH FUR MASCHINENBAU, wherein a washing agent dispenser kit capable of dispensing multiple washing agent doses is installed in a traditional washing machine.

In this solution, however, the tanks are filled by means of a special filling drawer provided by replacing the original drawer with a modified drawer essentially consisting of a simple tank filling mouth. In this regard, it should be pointed out that the water ducts afferent to a traditional single-dose drawer and required for flooding the latter have been totally eliminated in order to avoid tank flooding.

Even though this solution allows the tanks to be easily filled through the drawer, the original operation of the washing machine is changed, since it is transformed from a traditional machine using a drawer filled with a single dose by the user into a machine operating with bulk tanks. In this respect, also the original function of the dispenser drawer is completely lost, as a matter of fact, it completely loses the possibility of containing washing agents in single doses, since its only function is to provide access to the tanks.

SUMMARY OF THE INVENTION

The present invention aims at overcoming these and other drawbacks through a washing machine, such as a laundry washing or washing/drying machine, equipped with a drawer for loading washing agents.

The present invention is based on the idea of providing a washing machine which uses a single drawer both for loading single doses of washing agent and for filling at least one bulk tank arranged in a remote position with respect to the drawer and in fluid communication therewith.

Through a single operation carried out on the drawer, the user can, therefore, fill both the bulk tank and the single-dose compartment. This operation may be useful when the user wants to add to the wash cycle an additional agent (e.g. a dye fixative, a dye or the like) for which a dedicated tank does not exist or is not available.

It follows that a washing machine equipped with such a drawer provides much flexibility of use, because it can be used either as a traditional washing machine, wherein the user has to load the washing agents at every wash cycle, or as a washing machine provided with bulk tanks, which can be filled comfortably by the user without suffering the aforementioned drawbacks. It should be mentioned that such a washing machine will also allow for hybrid use combining both of the above modes of operation, i.e. the user can normally use the bulk tanks and, when necessary, add another washing agent (not contained in the tank) for particular wash types.

These features as well as further advantages of the present invention will become apparent from the following description of an embodiment thereof as shown in the annexed drawings, which are supplied by way of non-limiting example.

Further advantageous features will be set out in the appended claims.

DESCRIPTION OF THE PREFERRED EMBODIMENTS

Figure 1:
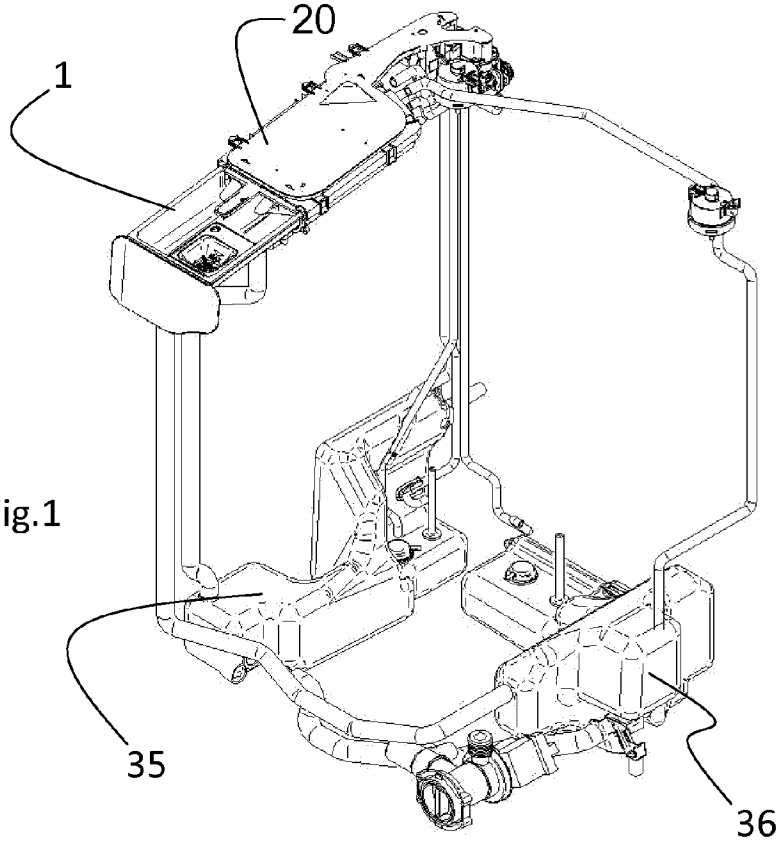
FIG. 1 is a schematic view showing a washing agent drawer, bulk tanks and connecting ducts according to the teachings of the present invention.

Referring now to FIG. 1, there is shown the position of a drawer 1 for loading washing agents in accordance with the teachings of the present invention; it is mounted in the upper part of the washing machine, which machine also comprises bulk tanks 35 and 36, which can contain a quantity of washing agent sufficient for several working cycles.

As can be seen, the tanks are arranged in the lower part of the washing machine, under drawer 1, which in FIG. 1 is shown in the partially extracted condition.

As will be further described below, the drawer 1 is connected to tanks 35 and 36 through respective filling ducts, so that the tanks can be filled from the drawer itself.

FIG. 1 does not show the washtub, which is in fluid communication with drawer 1; the latter can also be used for supplying washing agents directly into the tub.

As will be seen hereafter, drawer 1 can be extracted in at least two conditions, wherein it supplies washing agent either to the tanks or to the tub. In this regard, it should be mentioned right away that one position is defined as "partial extraction" to indicate a condition wherein the drawer is only partially extracted from its cavity, whereas the other position is defined as "full extraction" to indicate a condition wherein the drawer is fully extracted from the machine without however being detached from its slide rails; in this condition, in fact, the drawer is still engaged with the slide rails, and through these with the washing machine.

Figure 2:
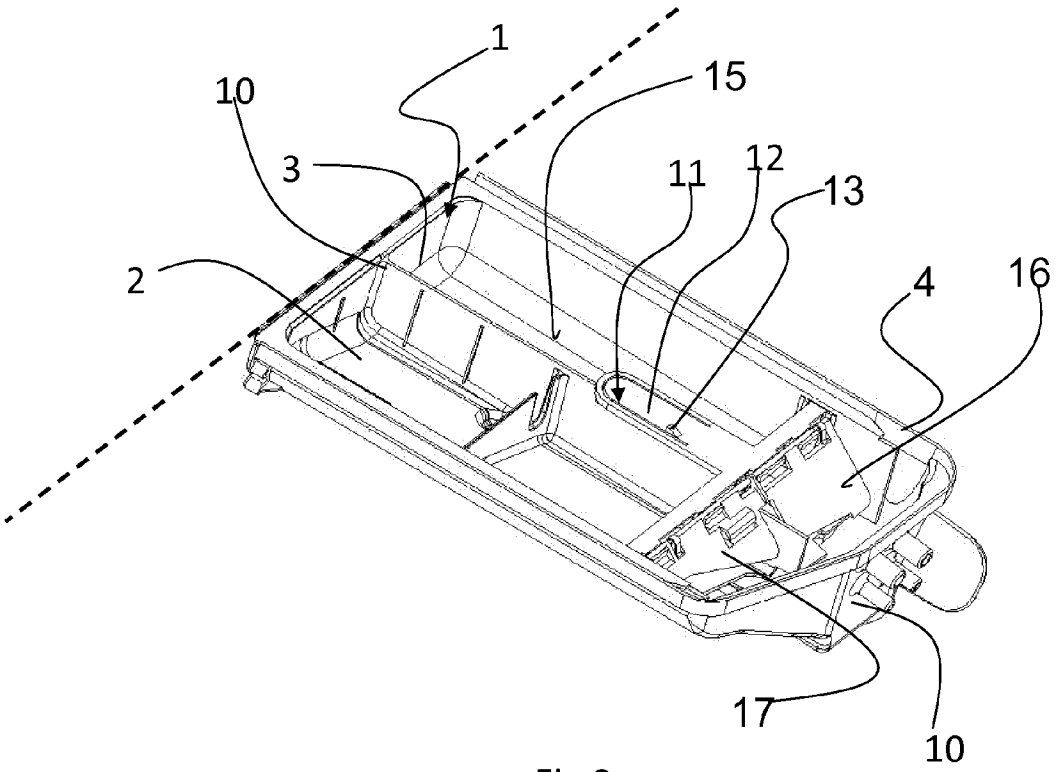
FIG. 2 is a perspective view of a first embodiment of the drawer of FIG. 1 in the fully retracted condition.
Figure 3:
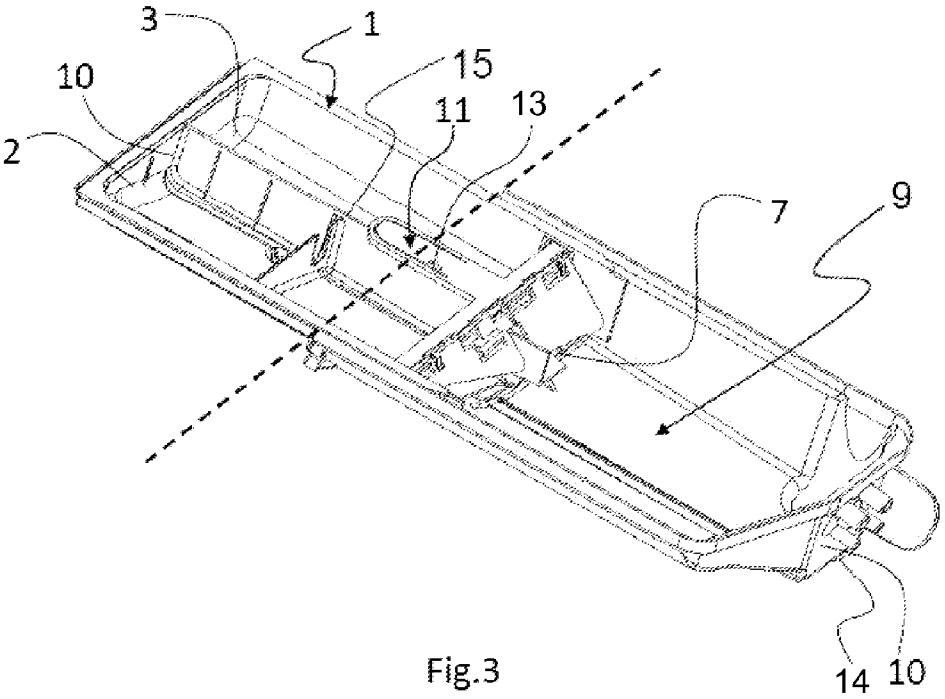
FIG. 3 is a perspective view of the drawer of FIG. 2 in the partially extracted condition.
Figure 4:
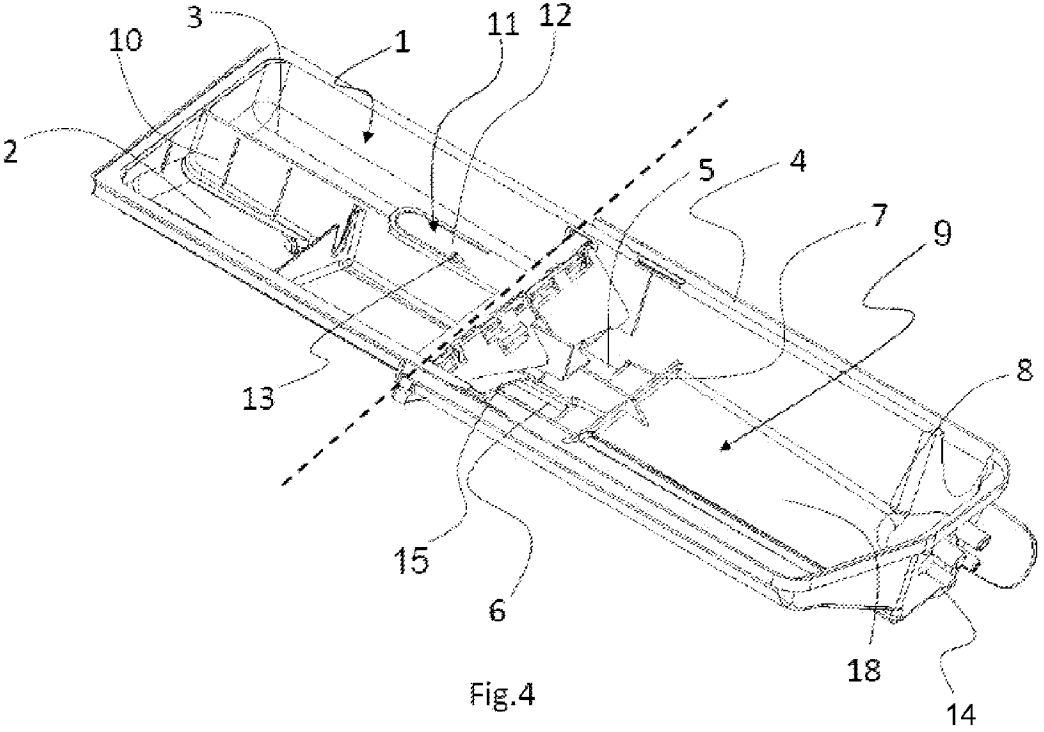
FIG. 4 is a perspective view of the drawer of FIG. 3 in the fully extracted condition.
Figure 5:
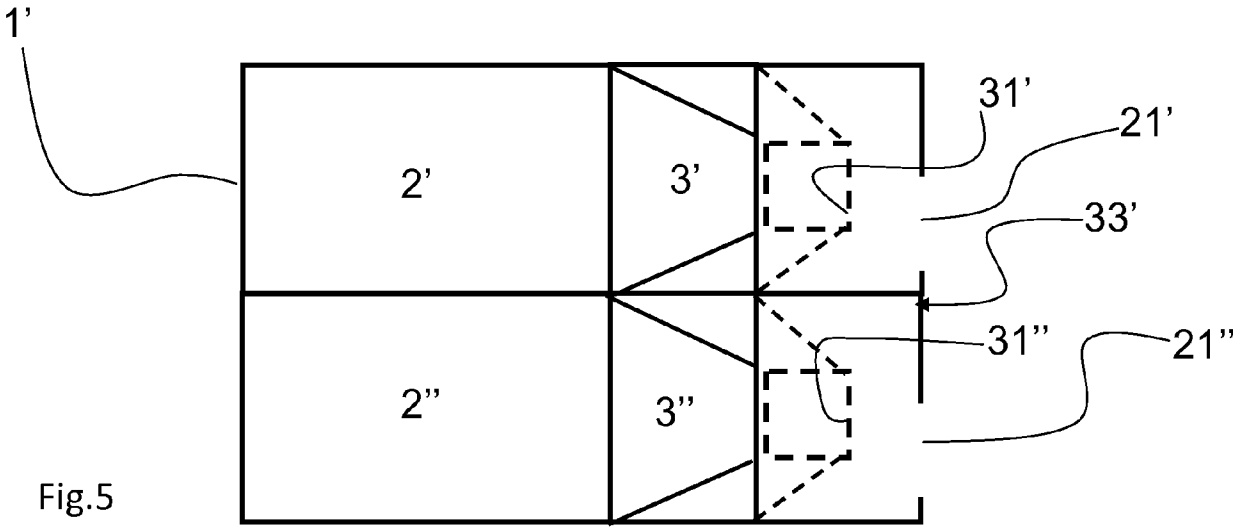
FIG. 5 is a plan view of a second embodiment of the drawer of FIG. 1.
Figure 6:
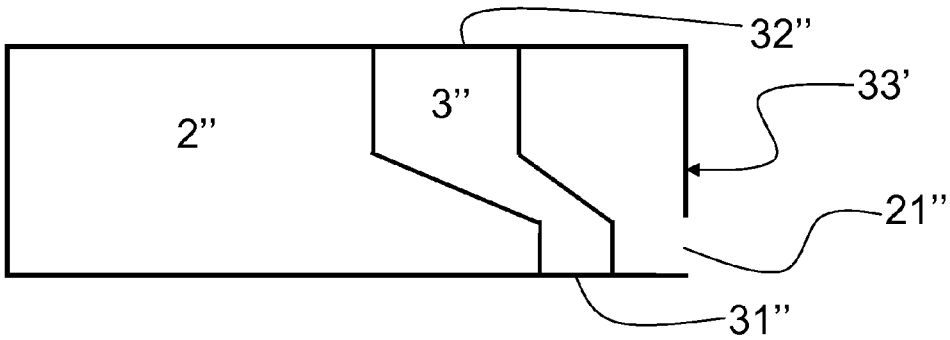
FIG. 6 is a sectional view of the drawer of FIG. 5.

In the first embodiment shown in FIGS. 2, 3 and 4, drawer 1 is shown in the fully retracted condition (FIG. 2) and in the partially and fully extracted conditions (FIGS. 3 and 4, respectively).

The dashed line indicates the edge (which is fixed in relation to the drawer) of top wall 20 of the drawer, beyond which the latter projects outwards for allowing a user to pour in the washing agents.

Of course, fixed top 20, and the edge thereof, may also coincide with the frame or cabinet of the washing machine.

Referring back to drawer 1, it can be seen that it comprises two open-top chambers 2 and 3 extending longitudinally from front wall 10 of drawer 1 to the rear region thereof, where they are not delimited by a rear wall for the reasons discussed hereafter.

In the illustrated example, drawer 1 also comprises stop means 11 adapted to stop the extraction travel in a position where drawer 1 is partially extracted and protrudes only partially from the edge of fixed top 20.

In the illustrated embodiment, stop means 11 consist of a flexible arm 12 fitted with an engagement tooth 13, which when drawer 1 is extracted interferes with the edge of top 20, thereby stopping it as soon as the partial extraction condition shown in FIG. 3 is attained; from this condition, in order to fully extract drawer 1 it is necessary to exert a certain force onto flexible arm 12, so as to push tooth 13 apart from the edge of top 20, thus freeing it from interference and allowing the drawer to be fully extracted to the position of FIG. 4.

Drawer 1 is also fitted with one oscillating door 16 and 17 for each chamber 2 and 3, which extends downwards to a certain distance from floor 15 of the chambers 2 and 3, so that the latter are de facto always open at the rear.

Housing seat 4 of drawer 1 has two drain apertures 5 and 6 in the bottom (shown in FIG. 4), which are in fluid communication with the ducts afferent to tanks 35 and 36; a partition wall 7 is adjacent to drain apertures 5 and 6 and faces rear wall 8 of housing seat 4; in addition to partition wall 7, floor 9 of housing seat 4 comprises an inclined portion 18 sloping down towards rear wall 8, where there is a drain 14 in fluid communication with the tub.

Drawer 1 can be extracted by translating it from the fully retracted position of FIG. 2 to two different positions, shown in FIGS. 3 and 4, corresponding to a partially extracted condition and a fully extracted condition.

As can be seen, in the two conditions of full retraction and partial extraction shown in FIGS. 2 and 3 drain apertures 5 and 6 are closed by floor 15 of chambers 2 and 3.

In particular, it should be pointed out that in the partially extracted condition floor 15 protrudes past the partition wall for the reasons explained below.

In fact, the washing agents are poured into the two chambers 2 and 3: referring to the condition of FIG. 3, drawer 1 is partially extracted beyond the dashed edge of top 20.

Chambers 2 and 3 are therefore accessible to a user, who can pour in a washing agent to be supplied directly into the wash tub. Floor 15 of chambers 2 and 3 ends past wall 7, thus closing the apertures 5 and 6, which in fact are not visible in this figure. The washing agent loaded into chambers 2 and 3 either stops in the chamber (e.g. when it is a powder) or is conveyed by gravity beyond wall 7 along inclined portion 18 of housing seat 4. In either case (i.e. whether the washing agent stays in chamber 2 or 3 or is conveyed into housing seat 4), during the wash cycle water comes in from the chamber top which drags the washing agent into duct 14 and from there into the tub, thus providing a single-dose type of loading operation, i.e. all the washing agent poured and residing in the drawer is used during one operating cycle of the machine.

It is apparent from the above description that when drawer 1 is in the partially extracted condition, the loaded washing agents are not supplied to tanks 35 and 36, since drain apertures 5 and 6 are closed.

The extraction of drawer 1 is stopped in the position shown in FIG. 3 by tooth 13 of flexible arm 12, which in this condition comes in contact with top 20, thereby stopping the drawer and avoiding that a user may pour by mistake into tanks 35 and 36 a washing agent intended for a single cycle.

When the user wants to fill tanks 35 and 36, he/she will have to exert a certain force onto flexible arm 12 until tooth 13 is disengaged from top 20, so that the drawer can be brought into the fully extracted condition shown in FIG. 4.

As can be seen, in this condition, floor 15 of chambers 2 and 3 will have translated past drain apertures 5 and 6, thereby uncovering them. Thus, a washing agent poured in drawer 1 in this condition will reach the rear portion, from where it will fall into drain apertures 5 and 6 and finally reach tanks 35 and 36.

In order to make this draining operation easier, floor 15 may be slightly inclined, so that the washing agent is conveyed by gravity towards the rear portion of drawer 1.

An alternative embodiment of the washing agent supply system is shown in FIGS. 5 to 11: it is also based on the principle of employing a drawer which can be used both for washing agents to be conveyed directly into the tub and for washing agents to be supplied to tanks 35, 36.

In this embodiment, drawer 1' comprises two open-top chambers 2' and 2" and two feedboxes 3' and 3" for separately loading two distinct washing agents, such as a softener (e.g. in 2' and 3') and a detergent (e.g. in 2" and 3").

Feedboxes 3' and 3" are intended for filling the bulk tanks 35 and 36, and for this purpose they are each provided with a bottom drain aperture 31', 31" which can be put in fluid communication with the tanks, as will be explained in detail hereafter. It should be mentioned beforehand that drain apertures 31' and 31" are offset in relation to upper inlet mouths 32' and 32", since they are located in the rear portion of drawer 1'.

Open-top chambers 2' and 2" are intended for loading washing agent doses to be used up in the course of one operating cycle of the machine. To this end, chambers 2' and 2" can be flooded with water, which will then flow out of chambers 2' and 2" towards the tub of the machine, dragging along the washing agent.

In accordance with the teachings of the present invention, feedboxes 3' and 3" are arranged in the rear portion of chambers 2' and 2", so that the latter extend under the inlet mouth and around the drain, up to rear wall 33' of drawer 1, where a drain port 21' and 21" is provided for each chamber to allow the contents of chambers 2' and 2" to be drained towards the tub.

Figure 10:
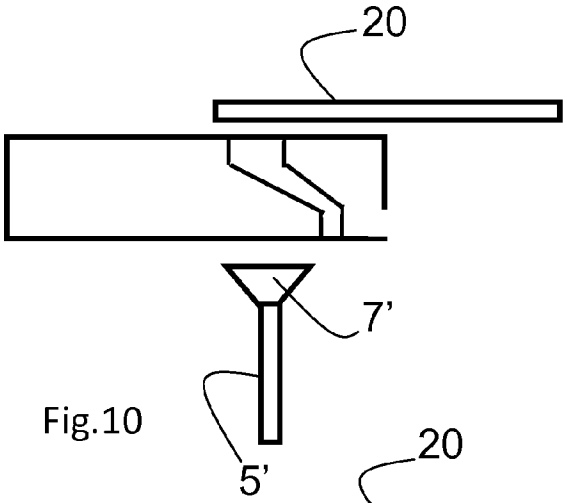
FIGS. 9, 10 and 11 are sectional views of the drawer of FIG. 5 in the fully retracted condition, in the partially extracted condition, and in the fully extracted condition, respectively.
Figure 11:
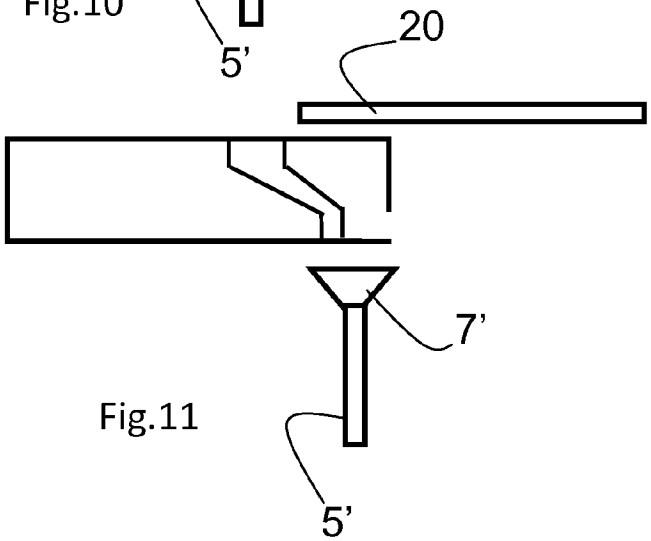
Figure 9:
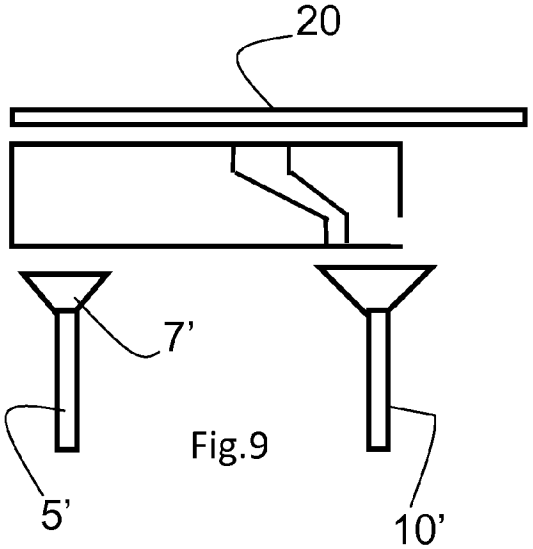

With reference to FIGS. 9 to 11, it can be seen that the drawer can be moved to at least one position (shown in FIG. 11), wherein chambers 2',2" and feedboxes 3',3" are both accessible and the latter are in fluid communication with tanks 35,36 to allow said tanks 35,36 to be filled with a washing agent, and one position (shown in FIG. 10) wherein feedboxes 3',3" are inaccessible and chambers 2',2" are accessible. FIG. 9 also shows the fully retracted position of drawer 1', wherein chambers 2',2" and feedboxes (3',3") are both inaccessible.

Figure 7:
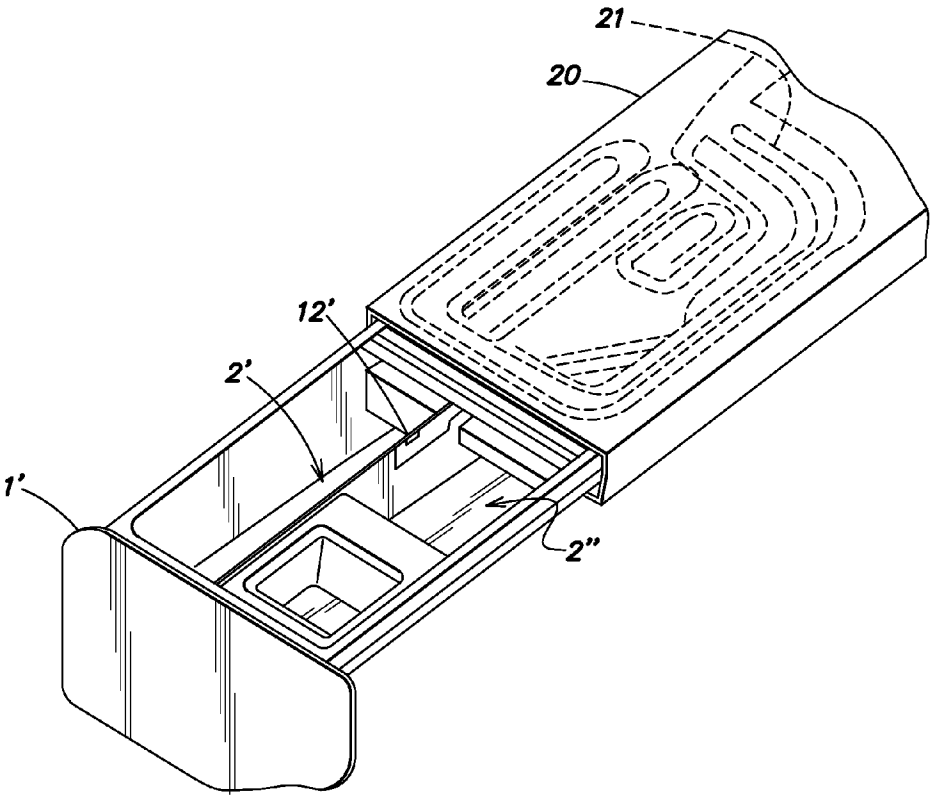
FIG. 7 is a perspective view of the drawer of FIG. 5 in the partially extracted position.

In fact, drawer 1' can be extracted from its housing and take the aforementioned different positions in relation to fixed top 20. Perspective views of the partially and fully extracted positions of the drawer are also shown in FIGS. 7 and 8, respectively.

When drawer 1' is moved to the partially extracted position, a user can only fill chambers 2' and 2" due to the fact that they project outwards from fixed top 20; it should be pointed out that in this condition, feedboxes 3' and 3" remain hidden and are therefore inaccessible.

Figure 8:
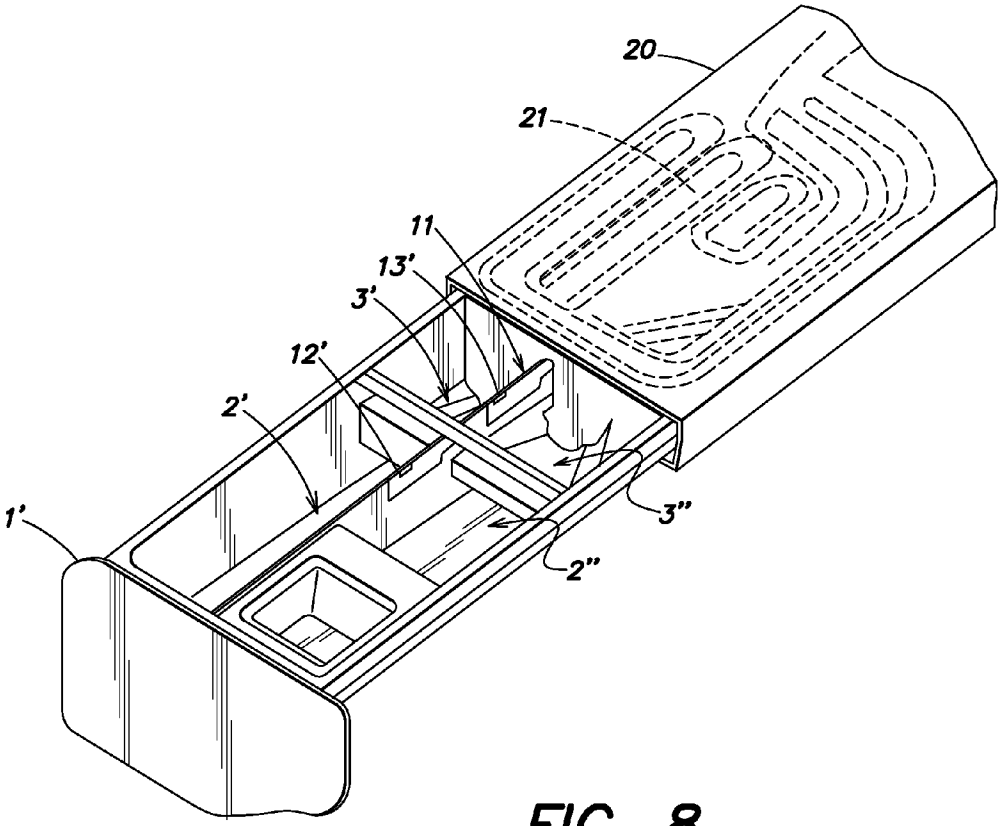
FIG. 8 shows the drawer of FIG. 7 in the fully extracted condition.

When drawer 1' is fully extracted, as shown in FIGS. 8 and 11, feedboxes 3' and 3" become accessible as well, since they now protrude outwards past fixed top 20.

Due to the fact that each drain aperture 31 is offset towards the rear wall of the drawer with respect to the inlet section, in the fully extracted condition, both feedboxes 3' and 3" are in fluid communication with fixed ducts 5' afferent to washing agent tanks 35 and 36, which are arranged in the lower part of the washing machine. Thus, the ducts are in fluid communication with feedboxes 3' and 3" only when drawer 1 is fully extracted; this feature prevents the tanks from being accidentally contaminated by water or dirt.

The ducts are also provided with two funnel-shaped mouths (the drawings only show mouth 7' of duct 5'), so as to facilitate the transfer of the washing agent and avoid any losses. The tanks can therefore be filled with respective washing agents only after the user has fully extracted drawer 1, thus exposing feedboxes 3' and 3", which in this condition are in fluid communication with the tanks.

When drawer 1' is retracted in the respective housing of the washing machine, i.e. when fixed top 20 covers it entirely (typically when the washing machine is in operation), apertures 21' and 21" are over drain duct 10' afferent to the tub, so that when chambers 2' and 2" are flooded, the water will carry the washing agent towards the tub by following drain duct 10' shown in FIG. 9.

The water is supplied from above through fixed top 20, which for this purpose has a number of holes opening into a water distribution channel 21.

If there is no washing agent in compartments 2' and 2", the user may without distinction choose either to flood them or not; if they are flooded, no washing agent will be dissolved and the water used will be conveyed into the tub through duct 10' without carrying along any washing agent.

It should be noted that, although feedboxes 3' and 3" and chambers 2' and 2" are both housed within drawer 1, during the flooding step, no water can enter the tanks because access thereto will be prevented by feedboxes 3' and 3" not being in fluid communication with ducts 5'.

In this respect, it is conceivable that the holes of channel 21 are only present in the portion over the open top of chamber 2' and 2", so as to prevent the outflowing water from hitting feedboxes 3' and 3", or the holes of channel 21 may also extend over feedboxes 3' and 3", which will then be hit by the water and discharge it through drain apertures 31' and 31", which, however, in this operating condition will no longer be facing ducts 5', but duct 10'; in this manner, any washing agent residues will also be removed from feedboxes.

It should be mentioned that this embodiment includes as well stop means 11 adapted to prevent the drawer from being inadvertently fully extracted. These means consist of an oscillating arm 13' interfering with fixed top 20, thereby preventing the drawer from being extracted beyond the partially extracted position. In order to let drawer 1' move to the fully extracted position, the oscillating arm can be brought into a non-interference position by acting upon a control a 12' arranged in the drawer area and accessible from the outside when the drawer is in the partially extracted condition. The movement of control arm 12' is coordinated with that of the oscillating arm so as to disengage the latter from top 20, thus allowing drawer 1' to translate towards the fully extracted position. The washing agent supply system described above therefore uses a single drawer for both loading washing agents to be conveyed directly into the tub and loading washing agents to be stored in a collection tank before being delivered to the tub.

The washing or washing/drying machine described herein also offers an extremely high degree of versatility: in fact, it accepts without distinction liquid and powder washing agents.

The remarkable versatility of this machine is also expressed by the fact that it can execute a wash program which uses the washing agents contained in the tanks, e.g. a detergent and a softener, and include in the same operating cycle at least another washing agent, not contained in the tanks, such as a dye fixative. According to the teachings of the present invention, it is possible to use in one wash cycle two washing agents different from each other and different from those contained in the tanks.

It is also worth mentioning that the user may advantageously fill bulk tanks 35 and 36 from above by carrying out a simple operation while staying in a comfortable position.

It should also be pointed out that no area intended exclusively for filling the tanks is taken up on the front wall of the machine, since no dedicated means are employed for this sole purpose: in fact, there are no dedicated tank filling doors, since the means for filling the bulk tanks (i.e. the drawer) are partly shared with the means for loading single doses of washing agents.

Of course, the example described herein may be subject to many variations without departing from the protection scope and from the objects of the present invention.

According to a possible variation, the drawer referred to herein as a drawer subdivided into two parts may however be subdivided into any number of parts.

It is also worth mentioning that the flooding may be obtained by using means other than those described herein, e.g. by arranging a simple water supply duct.

As a further variant, it should be noted that the funnel-shaped mouths of the ducts may be replaced with hoses following the movements of drawer 1. This solution is more advantageous in terms of watertight connections among the various parts.

The invention claimed is:

1. A washing machine, comprising:

at least one wash tub;

one tank for a washing agent; and one drawer for loading the washing agent, the drawer configured to be moved to a first position to put at least a portion of the drawer in fluid communication with only the tub, and the drawer further configured to move to a second position to put the at least a portion of the drawer in fluid communication with only the tank, wherein the first position is different than the second position.

2. The washing machine according to claim 1, wherein the first position corresponds to a partial extracted condition of the drawer and the second position corresponds to a full extracted condition of the drawer.

3. The washing machine according to claim 1, wherein the drawer comprises at least two open-top chambers accessible from an outside of the washing machine in both the first position and the second position.

4. The washing machine according to claim 3, wherein the drawer has a front wall and the at least two open-top chambers extend longitudinally from the front wall of the drawer to a rear region of the drawer, where a housing seat of the drawer includes an aperture for discharging the washing agent supplied into the at least two open-top chambers.

5. The washing machine according to claim 3, wherein the drawer has a floor, wherein the drawer includes a housing seat that is fixed with respect to the drawer and surrounds the drawer at least underneath the floor, the housing seat having a bottom with two drain apertures, the two drain apertures in fluid communication with said tank, said two drain apertures being closed by the floor of the drawer when the drawer is in a partial extracted condition, and the two drain apertures being open when the drawer is in a full extracted condition.

6. The washing machine according to claim 5, wherein the housing seat comprises a drain afferent to the tub, which opens in a proximity of a rear wall of the housing seat, so that the washing agent supplied into the at least two open-top chambers is conveyed towards the tub when the drawer is in the partial extracted condition or retracted.

7. The washing machine according to claim 5, wherein the housing seat also comprises a partition wall adjacent to the drain apertures and extending on the side of the drain apertures that faces a rear wall, and a floor including an inclined portion sloping down towards the rear wall, so that the washing agent is conveyed towards the drain apertures by gravity.

8. The washing machine according to claim 5, wherein the drawer comprises one oscillating door for each chamber of the at least two open-top chambers arranged in a rear portion of the chamber, and wherein the oscillating door extends downwards to a certain distance from the floor.

9. The washing machine according to claim 5, further comprising a fixed top arranged on the drawer and fixed with respect to the drawer, the fixed top including an edge beyond which the at least two open-top chambers of the drawer protrude partially or fully in the partial extracted condition or the full extracted condition, respectively.

10. The washing machine according to claim 3, wherein the drawer comprises at least one feedbox for loading the washing agent into the tank, and wherein the at least two open-top chambers are separated from the at least one feedbox for the purpose of containing the washing agent to be discharged into the tub.

11. A washing machine, comprising:

at least one wash tub;

one tank for a washing agent; and one drawer for loading the washing agent, the drawer configured to be moved to a first position to put at least a portion of the drawer in fluid communication with the tub where the at least a portion of the drawer is not in fluid communication with the tank when the drawer is in the first position, and the drawer further configured to move to a second position to put the at least a portion of the drawer in fluid communication with the tank where the at least a portion of the drawer is not in fluid communication with the tub when the drawer is in the second position, wherein the first position is different than the second position.

12. The washing machine according to claim 11, wherein the first position corresponds to a partial extracted condition of the drawer and the second position corresponds to a full extracted condition of the drawer.

13. The washing machine according to claim 11, wherein the drawer comprises at least two open-top chambers accessible from an outside of the washing machine in both the first position and the second position.

14. The washing machine according to claim 13, wherein the drawer has a front wall and the at least two open-top chambers extend longitudinally from the front wall of the drawer to a rear region of the drawer, where a housing seat of the drawer includes an aperture for discharging the washing agent supplied into the at least two open-top chambers.

15. The washing machine according to claim 13, wherein the drawer has a floor, wherein the drawer includes a housing seat that is fixed with respect to the drawer and surrounds the drawer at least underneath the floor, the housing seat having a bottom with two drain apertures, the two drain apertures in fluid communication with said tank, said two drain apertures being closed by the floor of the drawer when the drawer is in a partial extracted condition, and the two drain apertures being open when the drawer is in a full extracted condition.

16. The washing machine according to claim 15, wherein the housing seat comprises a drain afferent to the tub, which opens in a proximity of a rear wall of the housing seat, so that the washing agent supplied into the at least two open-top chambers is conveyed towards the tub when the drawer is in the partial extracted condition or retracted.

17. The washing machine according to claim 15, wherein the housing seat further comprises a partition wall adjacent to the drain apertures and extending on the side of the drain apertures that faces a rear wall, and a floor including an inclined portion sloping down towards the rear wall, so that the washing agent is conveyed towards the drain apertures by gravity.

18. The washing machine according to claim 15, wherein the drawer comprises one oscillating door for each chamber of the at least two open-top chambers arranged in a rear portion of the chamber, and wherein the oscillating door extends downwards to a certain distance from the floor.

19. The washing machine according to claim 15, further comprising a fixed top arranged on the drawer and fixed with respect to the drawer, the fixed top including an edge beyond which the at least two open-top chambers of the drawer protrude partially or fully in the partial extracted condition or the full extracted condition, respectively.

20. The washing machine according to claim 13, wherein the drawer comprises at least one feedbox for loading the washing agents into the tank, and wherein the at least two open-top chambers are separated from the at least one feedbox for the purpose of containing the washing agent to be discharged into the tub.

* * * * *

UNITED STATES PATENT AND TRADEMARK OFFICE

CERTIFICATE OF CORRECTION

PATENT NO. : 9,074,312 B2
APPLICATION NO. : 13/054989
DATED : July 7, 2015
INVENTOR(S) : Luca D'Andrea et al.

It is certified that error appears in the above-identified patent and that said Letters Patent is hereby corrected as shown below:

In the Specification:
Col. 1, line 10 should read:
which claims priority to Italian Application No.

Col. 1, line 12 should read:
hereby incorporated by reference in their entirety.

Col. 3, line 57 should read:
FIG. 1 does not show the wash tub, which is in fluid com- Col. 6, line 64 should read:
non-interference position by acting upon a control arm 12'

In the Claims:
Claim 20, Col. 10, line 17 should read:
washing agent into the tank, and wherein the at least two Signed and Sealed this
Eighth Day of December, 2015

Michelle K. Lee

Michelle K. Lee
*Director of the United States Patent and Trademark Office*